US011746991B2

(12) United States Patent
Li et al.

(10) Patent No.: US 11,746,991 B2
(45) Date of Patent: Sep. 5, 2023

(54) BENDABLE PHOTOGRAPHIC FILL LIGHT

(71) Applicant: GUANGDONG SIRUI OPTICAL CO., LTD., Zhongshan (CN)

(72) Inventors: Jie Li, Zhongshan (CN); Haimin Lin, Zhongshan (CN); Zhangxuan Yang, Zhongshan (CN); Qi Cai, Zhongshan (CN)

(73) Assignee: GUANGDONG SIRUI OPTICAL CO., LTD., Zhongshan (CN)

( * ) Notice: Subject to any disclaimer, the term of this patent is extended or adjusted under 35 U.S.C. 154(b) by 0 days.

(21) Appl. No.: 17/939,946

(22) Filed: Sep. 7, 2022

(65) Prior Publication Data

US 2023/0003365 A1 Jan. 5, 2023

(51) Int. Cl.

| | |
|---|---|
| ***F21V 17/02*** | (2006.01) |
| ***F21V 23/06*** | (2006.01) |
| ***F21V 14/02*** | (2006.01) |
| ***F21L 4/02*** | (2006.01) |

(52) U.S. Cl.

CPC ..... *F21V 17/02* (2013.01); *F21L 4/02* (2013.01); *F21V 14/025* (2013.01); *F21V 23/06* (2013.01)

(58) Field of Classification Search

CPC ..... F21V 17/02; F21V 14/025; F21L 4/02

See application file for complete search history.

(56) References Cited

U.S. PATENT DOCUMENTS

| | | | | |
|---|---|---|---|---|
| 10,591,114 | B1 * | 3/2020 | Lassen | F21V 15/013 |
| 2016/0069554 | A1 * | 3/2016 | Ladstaetter | F21V 23/06 362/418 |
| 2019/0226663 | A1 * | 7/2019 | Kalnins | F21S 2/005 |
| 2019/0279969 | A1 * | 9/2019 | Mülders | H05B 45/00 |
| 2020/0075557 | A1 * | 3/2020 | Kleijnen | H01L 25/0753 |
| 2021/0310639 | A1 * | 10/2021 | Chen | F21V 23/06 |

* cited by examiner

*Primary Examiner* — Christopher E Dunay
(74) *Attorney, Agent, or Firm* — Loeb & Loeb LLP

(57) ABSTRACT

A bendable fill light lamp comprises a plurality of segments of a lamp body assembly connected in a series or a sequence, wherein the lamp body assembly comprises a body for connecting the plurality of segments. Any two adjacent segments of the plurality of the segments are rotatably connected. Each of the plurality of the segments comprises a light-emitting surface as a fill light source. The body comprises a connecting member passing among the plurality of the segments. The connecting member comprises a bendable elastic body. In this way, during the use of the fill light, the bending of the intermediary segments may drive the sequential adjustment of the illumination angles of the light emitting parts on the intermediary segments. In one aspect, the light angle of the fill light may be adjusted and avoid phenomenon of multiple lights on the object to be photographed, which improves the shooting effect.

19 Claims, 12 Drawing Sheets

BENDABLE PHOTOGRAPHIC FILL LIGHT

CROSS-REFERENCE TO RELATED APPLICATION

This application claims priority to a Chinese patent application number 202210506436.2, filed on May 9, 2022, whose disclosure is incorporated by reference in its entirety herein.

TECHNICAL FIELD

The present application generally relates to the technical field of lamps, in particular to a bendable fill light lamp.

BACKGROUND

As known in the art, the lighting angle of a fill light used in photography tends to show the light coming from one source or origin. If one wishes to show the details of the object to be photographed as much as possible, one would need to arrange multiple fill light sources at multiple angles to increase lighting angles. When current fill light lamps are used, one would need to increase the areas of source of light. However, in so doing, areas of spots or focused points of light on the photographed object may be easily identified, creating an appearance of discontinuous and uneven lighting effect. This is undesirable.

SUMMARY

Therefore, embodiments of the present application provide technical solutions aim to overcome the defects of the problem of discontinuous fill light and poor effects. Aspects of the invention provide a bendable fill light lamp providing multiple fill lights from multi-angle while providing a continuous and uniform or even light source.

The technical solution provided by aspects of the invention above include:

In one embodiment, a bendable fill light lamp may include a plurality of segments of a lamp body assembly connected in a series or a sequence. In one embodiment, any two adjacent segments of the lamp body assembly may be rotatably connected, and each segment of the lamp body assembly may be provided with a light-emitting surface. Furthermore, in another embodiment, a connecting member may be passed between the segments of the lamp body assembly, and the connecting member may be a bendable elastic body. In one aspect, the plurality of segments of the lamp body assembly may be bent with the bending of the connecting member.

In a further embodiment, the plurality of light-emitting surfaces on the plurality of segments of the lamp body assembly may be located on the same side of the fill light lamp.

In yet another embodiment, the plurality of segments of the lamp body assembly may include a parallel arrangement state in a straight line arrangement, a forward curved arrangement state curving toward the side of the plurality of the light-emitting surfaces, and a back-curved arrangement state in which one side of the light-emitting surface may be curved.

In yet a further embodiment, when the plurality of segments of the lamp body assembly are in the parallel arrangement state, the plurality of the light-emitting surfaces may be located on the same plane.

In yet a further embodiment, in any two adjacent segments of the lamp body assembly, one end of each of the segments the lamp body assembly may be provided with a connecting member protruding outward from each of the segments. In another aspect, a mounting groove may be provided on the other end of the lamp body assembly to receive the connecting member. In one aspect, a side wall of the connecting member may include a first installation hole or opening, and the other side wall of the connecting member may include a second installation opening or hole at a location corresponding to that of the first installation opening or hole. In another embodiment, the first installation opening and the second installation may include a pin passing through the two installation holes, wherein the pin may be passed between the first installation hole and the second installation hole, and the two adjacent segments of the lamp body assembly may be rotatably around the pin.

In yet a further embodiment, an installation channel or chamber may be included in each of the plurality of segments of the lamp body assembly. In one example, the connecting member may be passed therethrough for connecting the plurality of installation channels.

In yet a further embodiment, the connecting member be composed of a bendable metal tube or metal sheet.

In yet a further embodiment, there may be one or more connecting member.

In yet a further embodiment, the lamp body assembly includes a head-end segment at the a head-end of the lamp body assembly, a tail-end segment of the lamp body assembly at a tail-end, and a plurality of intermediary segments connected between the head-end segment and the tail-end segment.

In yet a further embodiment, the head-end segment of the lamp body assembly includes a head-end bottom casing or shell, a head-end surface casing or shell, a head-end electrical circuit board, a head-end lamp board, a head-end lampshade and a battery. In one aspect, the head-end bottom shell and the head-end surface shell may be interlocked together. In one aspect, the head-end lampshade and the head-end bottom shell may be engaged with a side facing away from the head-end surface shell. In a further aspect, the head-end electrical circuit board may be arranged inside the head-end bottom shell and the head-end surface shell. In one aspect, the connecting member may be inserted between the head-end bottom shell and the head-end surface shell. In yet a further aspect, the head-end lamp board may be arranged on the side of the head-end bottom shell facing away from the head-end surface shell and may be covered by the head-end lampshade. In one aspect, the battery may be disposed or installed on the side of the head-end bottom shell facing away from the head-end surface shell.

In yet a further embodiment, each of the plurality of intermediary segment may include an intermediary main body, an intermediary lamp board and an intermediary lampshade. In one aspect, the connecting member may be passing through the intermediary main body. In one aspect, the intermediary lampshade may be attached to one side of the intermediary main body. In yet another embodiment, the intermediary lamp board may be disposed on the intermediary main body and covered by the intermediary lampshade.

In yet a further embodiment, the tail-end segment may include a tail-end bottom casing or shell, a tail-end surface casing or shell, a tail-end light board and a tail-end lampshade. In one aspect, the tail-end bottom shell and the tail-end surface shell may be engaged with another together. In one aspect, the tail-end lampshade may be engaged with a side of the tail-end bottom shell facing away from the tail-end surface shell. In a further aspect, the connecting member may be inserted between the tail-end bottom shell and the tail-end surface shell. In another aspect, the tail-end lamp board may be disposed on one side of the tail-end bottom shell facing away from the tail-end surface shell and may be covered by the tail-end lampshade.

In yet a further embodiment, one end of the head-end segment of the lamp body assembly facing away from the intermediary lamp body assembly and one end of the tail-end lamp body assembly facing away from the intermediary lamp body assembly are detachably connected.

In yet a further embodiment, an end of the head-end segment facing away from the intermediary main body may be provided with a quick-release member A. In another aspect, an end of the tail-end segment facing away from the intermediary main body may be provided with a quick-release member B, wherein the quick-release member B may be reciprocally fastened to the quick-release member A. The quick-release member A and the quick-release member B may be mutually or reciprocally connected or buckled to realize the lateral connection of the two fill light segments.

In yet a further embodiment, based on above configurations, one or more fill light lamp assemblies may be connected in a longitudinal direction.

In yet a further embodiment, the end of the head-end segment facing away from the intermediary main body may be provided with a head-end mounting hole for receiving a head-end connecting pin so that the head-end connecting pin may be installed. In another embodiment, the end of the tail-end segment facing away from the intermediary segment may be provided with a tail-end mounting hole for receiving a tail-end connecting pin so that the tail-end connecting pin may be installed. In one further embodiment, a plurality of the longitudinally arranged head-end connecting pin may connect to the another head-end segment (e.g., via a head-end connecting bracket). Similarly, a plurality of the longitudinally arranged tail-end connecting pin may connect to the another tail-end segment (e.g., via a tail-end connecting bracket) in the longitudinal direction.

The technical solution of embodiments of the present application may include the following advantages:

1. The bendable fill light provided by aspects of this application may include multi-segment lamp body assembly connected in sequence, and any two adjacent lamp body assemblies or segments may be rotatably connected, with a connecting member passing through and connecting the segments. In one aspect, the connecting member is bendable so as to enable the different segments and adjustment fill light lamp assembly. In one embodiment, the connecting member may hold its position or stiffness once it's bent in place so that different segments of the lamp body assembly may be adjusted to be in one or more illumination angles so that the light-emitting surfaces or sides may direct lights the object. In addition, the light provided from the fill light lamp is continuous and uniform. Aspects of the invention avoid multiple light spots on the object when photographed.

2. The bendable fill light lamp provided by this application includes the multiple segments, which enable the segments to position or arranged in a parallel arrangement state. In one aspect, the segments may not be bent so they are straight while providing a panel of fill light lamp. When the light lamp assembly is in a bent position or state (e.g., forward bending) with the light-emitting surfaces facing the object, the source of the light may be in a focused position, giving a spotlight effect on the object. When the light lamp assembly is in a backward bending position or state away from the object, the fill light lamp may provide an effect of light flooding or spreading effect.

3. In one embodiment, the light-emitting surfaces of the segments of the fill light lamp assembly may be positioned on the same plane. In one aspect, this arrangement may avoid or alleviate having light sources coming from different light surfaces and may create negative appearances on the object, such as having light and dark boundary lines on the photographed objects during shooting.

4. In one aspect, adjacent two segments of the fill light lamp may be connected through the connecting member and the corresponding groove. This configuration may ensure that the adjacent segments may be in a parallel arrangement state and may connect with each other with a stable connection. Further, in one embodiment, the gap between the two adjacent segments may be reduced as much as possible through the above configuration. With this approach, the lighting exposure may be continuous.

5. In a further aspect, the connecting member may be disposed in the interior of the segments in the groove or installation channel. In such arrangement, the connecting member may be concealed or may be hidden from viewing to users. In one embodiment, the exterior appearance of the fill light lamp is aesthetically pleasing. In yet another embodiment, when the fill light lamp assembly is bent in different directions, the force required to be applied on the fill light lamp assembly is more consistent.

6. In yet another embodiment, the fill light lamp may include or consist of a bendable metal tube. In one aspect, the metal tube may include a high bending stress and may not be prone to permanent deformation due to repeated bending. This is beneficial for the multi-segment fill lamp assembly to maintain its position.

7. In a further aspect, the fill light lamp assembly is composed of the head-end segment, the intermediary segment and the tail-end segment and that they are arranged in a series or in sequence. In one aspect, when the number of the intermediary segments becomes larger or substantial, the fill lighting effect is especially pronounced and effective.

8. In yet another embodiment, the head-end segment, the intermediary segment, and the tail-end segment may be connected in series, electrically. In one aspect, the head-end electrical circuit board may be configure to control the power on and off switch. In yet a further aspect, the battery may power the head-end electrical circuit board. In one aspect, this configuration conserve energy by having the plurality of segments shares the same head-end electronic circuit board and the battery, thus reducing the complicated need for the intermediary segments having the switch or battery. In this embodiment, this further reduces the production cost.

9. In yet another embodiment, the one end of the head-end segment and the one end of the tail-end segment may include a quick-release or detachably connected connector. This configuration, in one embodiment, may provide the lateral connection of two or more fill light lamps. This further aspect may enable the fill light lamps to be joined together to create larger size and bigger angle mapping or matrix of the fill light effect.

10. In yet another embodiment, the plurality of intermediary segments be connected longitudinally as a whole, so that a larger area of intermediary segments may be achieved.

BRIEF DESCRIPTION OF THE DRAWINGS

In order to more clearly illustrate the specific embodiments of the present application or the technical solutions in the prior art, the accompanying drawings that need to be used in the description of the specific embodiments or the prior art will be briefly introduced below. The drawings are some embodiments of the present application. For those of ordinary skilled in the art, other drawings can also be obtained from these drawings without any creative effort.

REFERENCE LABELS IN FIGURES

100: bendable fill light lamp; 110: head-end segment; 111: head-end bottom casing or shell; 112: head-end surface casing or shell; 113: head-end electrical circuit board; 114: head-end lamp board; 115: head-end lampshade; 116: battery; 117: quick-release member A; 118: head-end mounting hole; 120: intermediary segment; 121: intermediary main body; 122: intermediary lamp board; 123: intermediary lampshade; 130: tail-end segment; 131: tail-end bottom casing or shell; 132: tail-end surface casing or shell; 133: tail-end lamp board; 134: tail-end lampshade; 135: quick-release member B; 200: connecting member; 300: connecting channel or chamber; 400: connecting port; 410: first installation hole; 420: second installation hole; 500: connecting pin; 600: head-end connecting pin; 700: tail-end connecting pin; 800: head-end connecting bracket; and 900: tail-end connecting bracket.

DETAILED DESCRIPTION

The technical solutions of the present application may be clearly and completely described below with reference to the accompanying drawings. Obviously, the described embodiments are part of the embodiments of the present invention, but not all of the embodiments. Based on the embodiments in the present application, all other embodiments obtained by those of ordinary skilled in the art without creative efforts shall fall within the protection scope of the present application.

In the description of this application, it should be noted that the terms "center", "upper", "lower", "left", "right", "vertical", "horizontal", "inner", "outer", etc., where indicated orientation or positional relationship is based on the orientation or positional relationship shown in the accompanying drawings, which is only for the convenience of describing the present application and simplifying the description, rather than indicating or implying that the indicated device or element must have a specific orientation or a specific orientation, construction or operation, and therefore should not be construed as limitations on this application. Furthermore, the terms "first", "second", and "third" are used for descriptive purposes only and should not be construed to indicate or imply relative importance.

In the description of this application, it should be noted that, unless otherwise expressly specified and limited, the terms "installed", "engaged with" and "connected to" should be understood in a broad sense, for example, it may be a fixed connection or a detachable connection, or connection in one piece or an integral way. In another example, it may be a mechanical connection or an electrical connection; it may be a direct connection or an indirect connection through an intermediate medium, and it may be an internal communication of two elements. For those of ordinary skilled in the art, the specific meanings of the above terms in this application may be understood in specific situations.

Figure 1:
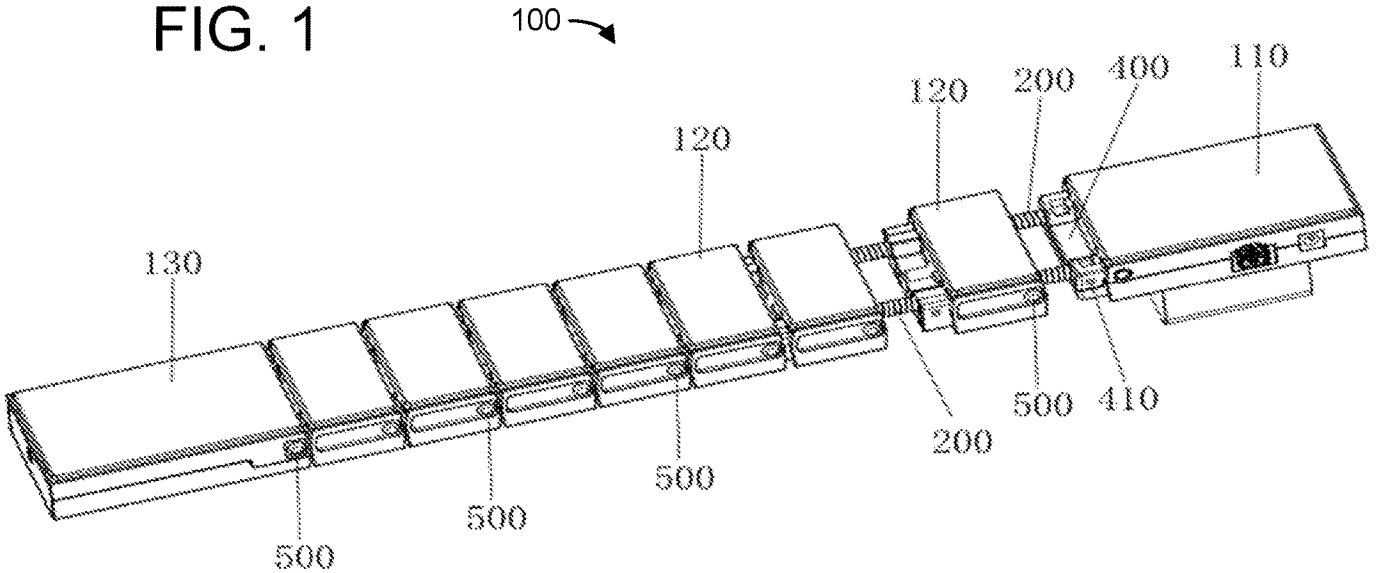
FIG. 1 is a schematic diagram of the overall structure of a flexible or bendable fill light lamp according to an embodiment of the invention, wherein a head-end segment and an intermediary segment are translated outward for a certain distance to display the internal connectors.
Figure 2:
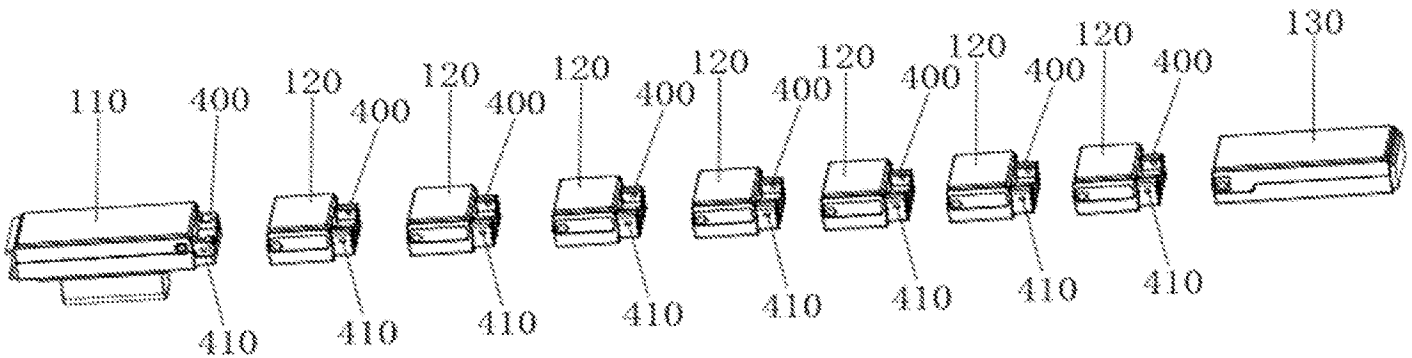
FIG. 2 is an exploded schematic diagram of a head-end segment, an intermediary segment, and a tail-end segment according to one embodiment of the invention.
Figure 3:
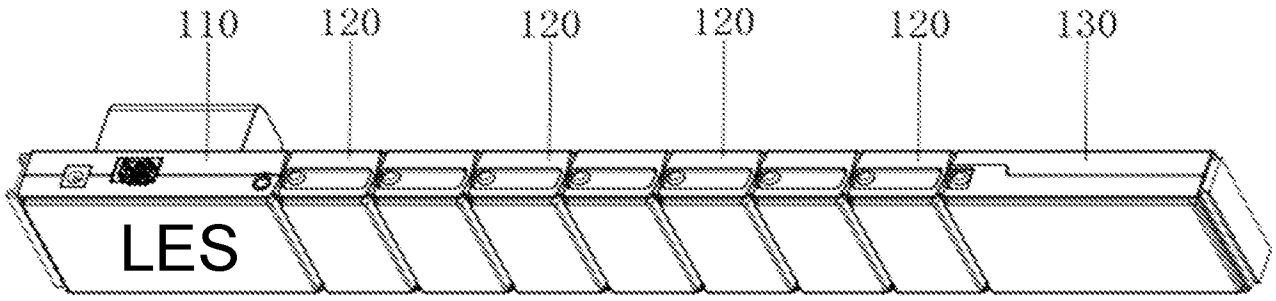
FIG. 3 is a schematic diagram of the overall structure of the flexible or bendable fill light lamp according to one embodiment of the invention in a state of parallel arrangement.

Referring now to FIGS. 1-3, diagrams and schematics showing a bendable or flexible fill light lamp 100 according to one embodiment. In one example, the bendable fill light lamp 100 may be a multi-segment fill light lamp assembly. In one aspect, the bendable fill light lamp 100 may include a head-end segment 110, multi-segment intermediary segments 120, and a tail-end segment 130. In one embodiment, the head-end segment 110 and the intermediary segments 120 may include, in any adjacent two intermediary segments 120, and the intermediary segment 120 and the tail-end segment 130 may be movably or rotatably connected. In one aspect, the head-end segment 110, the intermediary segments 120 and the tail-end segment 130 may be configured to include one or more lighting sources. In one embodiment, the one or more lighting sources of the head-end segment 110, the intermediary segment 120, and the tail-end segment 130 may be disposed on the same side of the bendable fill light lamp, so that the one or more lighting sources may be continuously or consecutively arranged. In one aspect, one or more connecting member 200 may be configured or disposed in the interior of the head-end segment 110, the intermediary segment 120, and the tail-end segment 130. In one embodiment, the connecting member 200 may be of a flexible material. In another embodiment, the intermediary segments 120 may be bent or curved in response to the curvature of the connecting member 200.

In another aspect, the bendable fill light lamp 100 may be structured with a plurality of segments each with a lighting source and the plurality of segments are connected with one another with any two adjacent segments movably or rotatably connected. As shown in FIG. 1, the segments include interior chambers or channels to receive the connecting member 200. When the bendable fill light lamp 100 is in use, the plurality of segments 120 may be moved through the curvature, angle or shape of the connecting member 200 to adjust or provide the various lighting angles needed for the photographing needs. In one embodiment, the bendable fill light lamp 100 may also provide and adjust at will of the angle of light due to its flexibility. In addition, the fill lighting may be continuous and uniformly presented or shone on the object. In one aspect, the effect of the lighting based on the bendable fill light lamp 100 may alleviate or avoid the effects of shadow or multiple light spots on the object when photographed.

Specifically, the light emitting surface (LES) of the head-end segment 110, the intermediary segment 120, and the tail-end segment 130 may be disposed on the same plane. By so doing, the bendable fill light lamp 100 may eliminate, avoid or alleviate having light and dark boundary lines on the photographed objects during shooting as a result of having two adjacent segments' light shining on the object from different distances.

In one embodiment, the intermediary segment 120 may include segments. The head-end segment 110 and the tail-end segment 130 may be disposed at the head position and the tail position of the intermediary segment 120. In one aspect, the intermediary segment 120, the head-end segment 110, and the tail-end segment 130 may be configured in a block structure with the light sources on flat surfaces. In one aspect, the lengths of the head-end segment 110 and the tail-end segment 130 are greater than that of the intermediary segment 120. In one aspect, the number of the intermediary segment 120 may not be limited to seven as shown in FIGS. 1-2. In one aspect, the number may vary. In one aspect, the higher the number of the intermediary segment 120, the width of each of the segments in the intermediary segment 120 may be reduced, thus further increasing the uniformity and continuity of the fill light. In another aspect, the shapes of the intermediary segment 120, the head-end segment 110 and the tail-end segment 130 may vary and may not need to be in the block structure as shown. It is to be understood that other shapes or designs may be perceived, as long as each segment may be connected and that the lighting source on each may be consecutively arranged, without departing from the scope and spirit of the invention.

Figure 7:
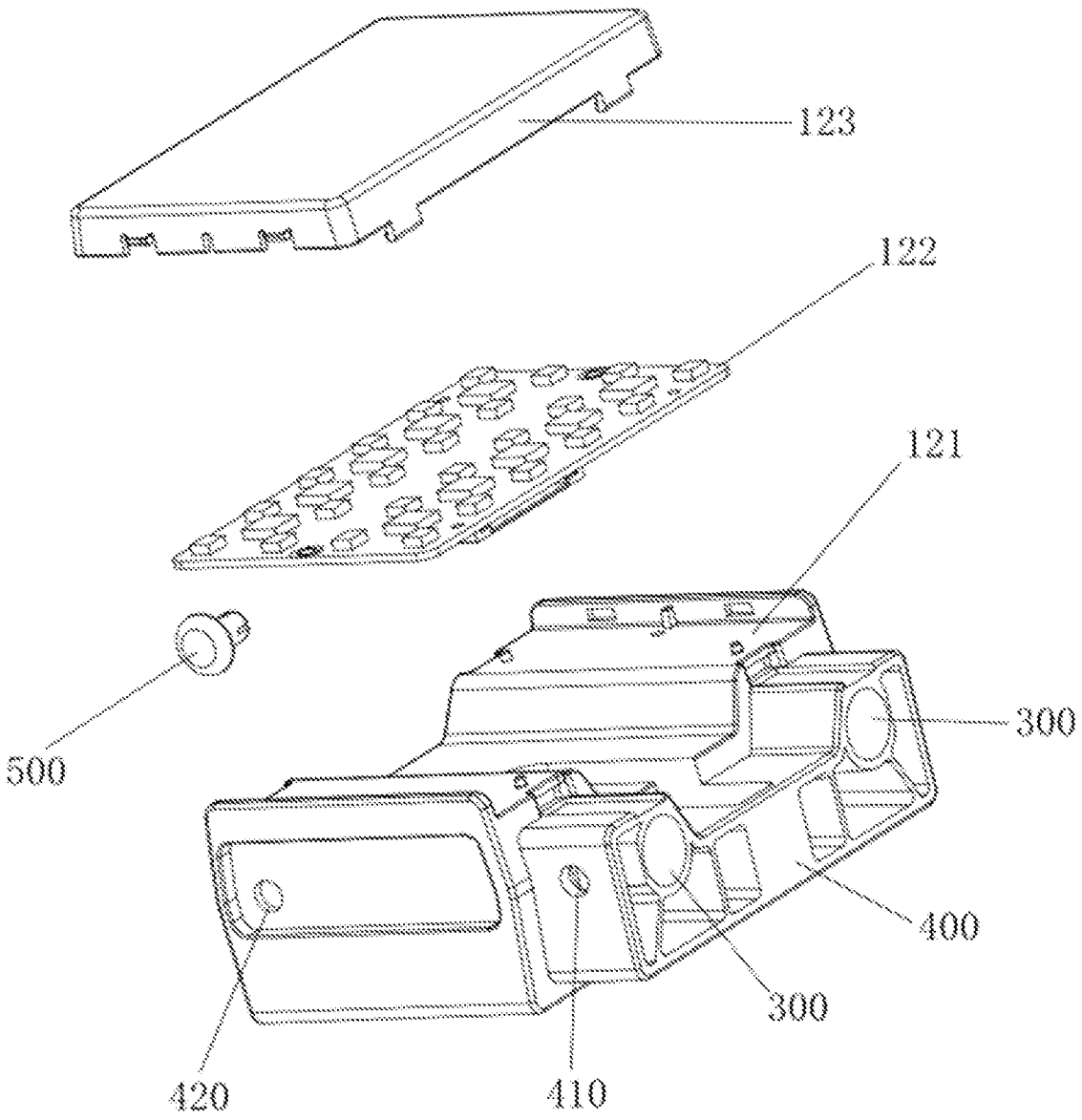
FIG. 7 is an exploded view of the intermediary segment according to one embodiment of the invention.

In one embodiment, the head-end segment 110, the intermediary segment 120, and the tail-end segment 130 may internally or within each of its interior space may permit the connecting member 200 to pass through or disposed in the connecting channel or chamber 300. In one aspect, the connecting member 200 may be disposed in or between one or more connecting channel or chamber 300. In one embodiment, the intermediary segment 120 may provide the one or more connecting channel or chamber 300 in the intermediary main body 121, as shown in FIG. 7. In one aspect, the connecting member 200 may pass through the one or more connecting channel or chamber 300 of the segments. By so doing, the bendable fill light lamp 100 may conceal the connecting member 200 so that the bendable fill light lamp 100 may be aesthetically pleasing. In yet another embodiment, when the bendable fill light lamp 100 may be bent in different directions, the force required to be applied on the bendable fill light lamp 100 is more consistent.

In yet another embodiment, the connecting member 200 may be metallic bendable tube. In another embodiment, there may be two tubes. The bendable metal tube structure may withstand high bending stress, and may not be prone to permanent deformation due to bending. In one aspect, the connecting member 200 may be conducive to maintaining the stability of the arrangement state of the multi-segment bendable fill light lamp 100. The provision of two metal tubes, in one aspect, may be beneficial for the multi-segment fill light lamp assembly to maintain its own balance during the bending process of the bendable fill light lamp 100. In a further embodiment, the configuration of the two tubes may further alleviate or prevent the bendable fill light lamp 100 from rotating. In an alternative embodiment, the number of metal tubes may also be one, three or more, and the metal tubes may also be replaced by elastic metal sheets.

Figure 5:
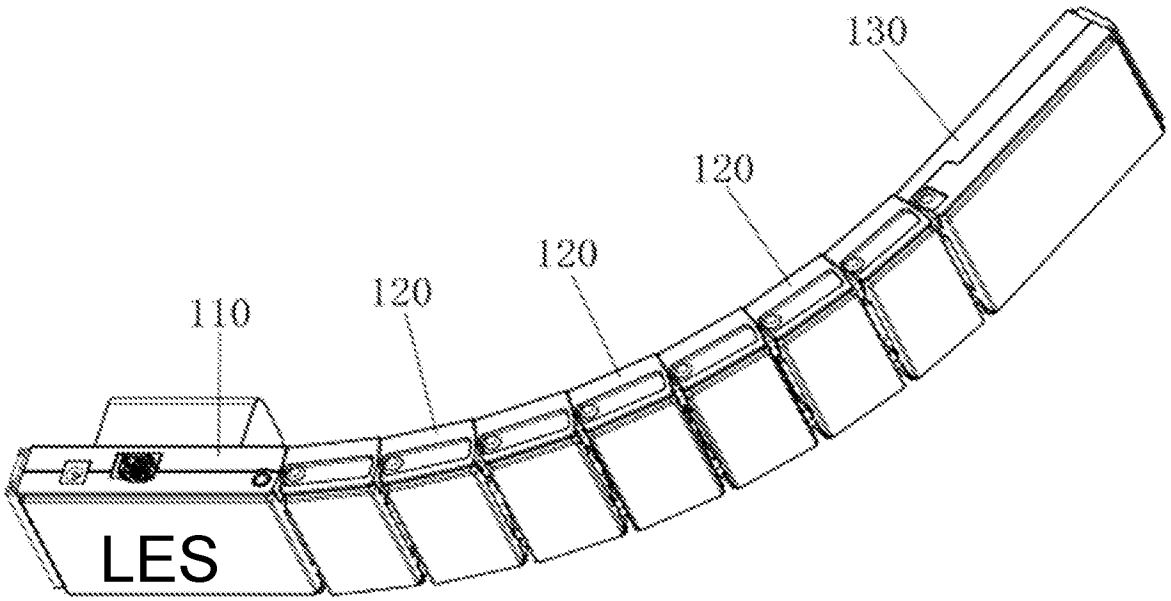
FIG. 5 is a schematic diagram of the overall structure of the flexible or bendable fill light lamp according to one embodiment of the present invention in a back-bending arrangement.
Figure 4:
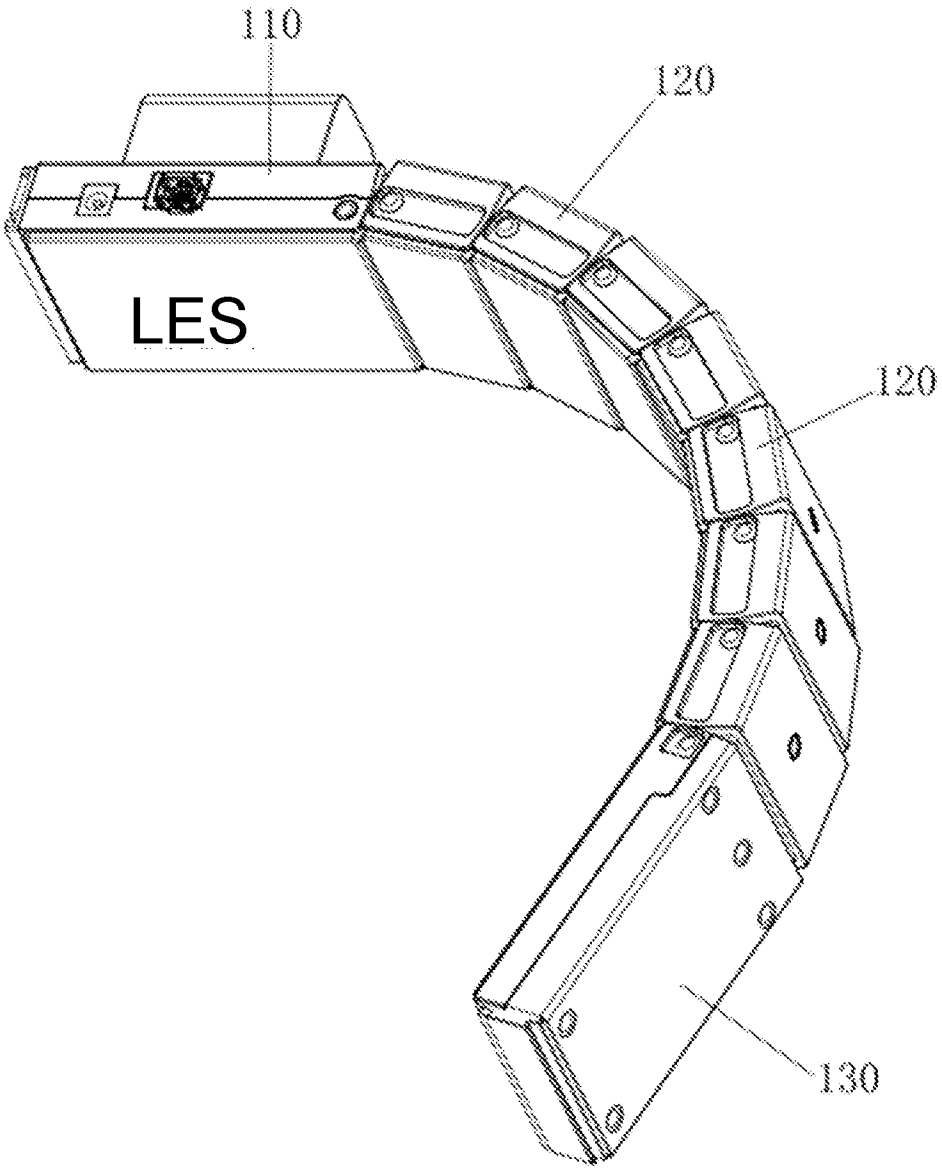
FIG. 4 is a schematic diagram of the overall structure of the flexible or bendable fill light lamp according to one embodiment of the present invention in a forward curved arrangement.

As shown in FIGS. 3-5, the head-end segment 110, the intermediary segment 120, and the tail-end segment 130 may include a parallel arrangement state in a straight line arrangement during the bending process of the connecting member 200 with the light-emitting surface side facing or curving forward in a curved arrangement state or the backward curved arrangement state curved on the side facing away from the light-emitting surface. When the bendable fill light lamp 100 is in a parallel arrangement, the multiple light-emitting surfaces, as shown, are on the same plane. In another embodiment, when the bendable fill light lamp 100 is in a forward curving arrangement or a backward curving arrangement, the multiple light-emitting surfaces are on the same plane. In one embodiment, the arrangement may be in a continuous arc surface. In another embodiment, the bendable fill light lamp 100 may be switched among a parallel arrangement state, a forward bending arrangement state and a backward bending arrangement state. In one aspect, when the bendable fill light lamp 100 is in the parallel arrangement, the parallel fill lighting configuration may be realized. In yet another aspect, when the bendable fill light lamp 100 is in the forward bending arrangement state, the bendable fill light lamp 100 may enable the fill light sources function as spotlights or the source of the light may be in a focused position, giving a spotlight effect on the object. In yet further aspect, wherein the bendable fill light lamp 100 is in the backward bending arrangement state, the bendable fill light lamp 100 may provide an effect of light flooding or spreading effect.

Figure 6:
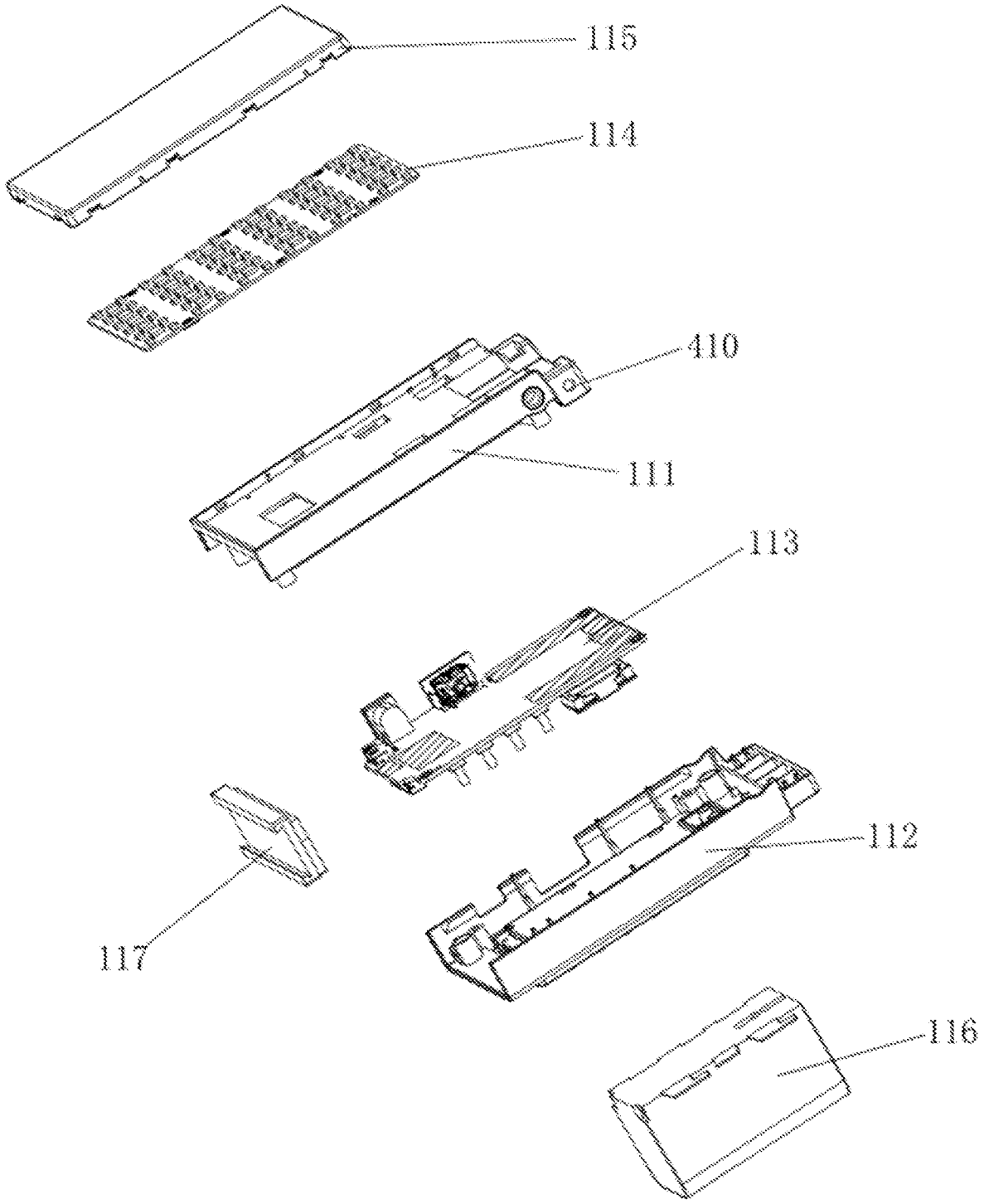
FIG. 6 is an exploded view of the head-end segment according to one embodiment of the invention.

As shown in FIG. 6, the head-end segment 110 may include the head-end bottom casing or shell 111, the head-end surface casing or shell 112, the head-end electrical circuit board 113, the head-end lamp board 114, the head-end lampshade 115 and the battery 116. In one aspect, the head-end bottom casing or shell 111 may be fastened to the head-end surface casing or shell 112. In one aspect, the head-end lampshade 115 may be fastened to the side of the head-end bottom casing or shell 111 that faces away from the head-end surface casing or shell 112. The head-end electrical circuit board 113 may be arranged inside the head-end bottom casing or shell 111 and head-end surface casing or shell 112. In one aspect, the connecting member 200 may be arranged between the head-end bottom casing or shell 111 and the head-end surface casing or shell 112. The head-end lamp board 114 may be installed on the side of the head-end bottom casing or shell 111 facing away from the head-end surface casing or shell 112 and covered by the head-end lampshade 115. In one aspect, the battery 116 may be installed on the head-end surface casing or shell 112 facing away from the head-end bottom casing or shell 111 on one side. Specifically, the head-end electrical circuit board 113 may be locked on the inside of the head-end surface casing or shell 112 through fastening devices, such as screws. In a further aspect, the battery 116 may be assembled on the outside of the head-end surface casing or shell 112 through snaps. In one embodiment, the head-end lamp board 114 may be locked on the head-end surface casing or shell 112 through fastening devices, such as screws. In one aspect, the outside of the end bottom casing or shell 111 and the head-end lampshade 115 may be assembled on the outside of the head-end bottom casing or shell 111 by snaps. In a further aspect, the head-end bottom casing or shell 111 may be locked on the head-end surface casing or shell 112 through fastening devices, such as screws. In a further embodiment, one end of the head-end surface casing or shell 112 and the head-end bottom casing or shell 111 may be fixedly connected with a quick-release member A 117 by fastening means, such as screws.

Referring to FIG. 7, in one embodiment, the intermediary segment 120 may include the intermediary main body 121, the intermediary lamp board 122, and the intermediary lampshade 123. In one aspect, the connecting member 200 may be disposed or installed on the intermediary main body 121. In one aspect, the intermediary lampshade 123 may be connected on one side of the intermediary main body 121. In one aspect, the intermediary lamp board 122 may be disposed or installed on the intermediary main body 121 and may be covered by the intermediary lampshade 123. Specifically, the intermediary lamp board 122 may be secured or fastened to the intermediary main body 121. In another embodiment, the intermediary lampshade 123 may be snapped to the intermediary main body 121. In a further aspect, the intermediary main body 121 may be in a framed structure, and the intermediary main body 121 may be include the connecting channel or chamber 300 for receiving the connecting member 200 to pass through.

Figure 8:
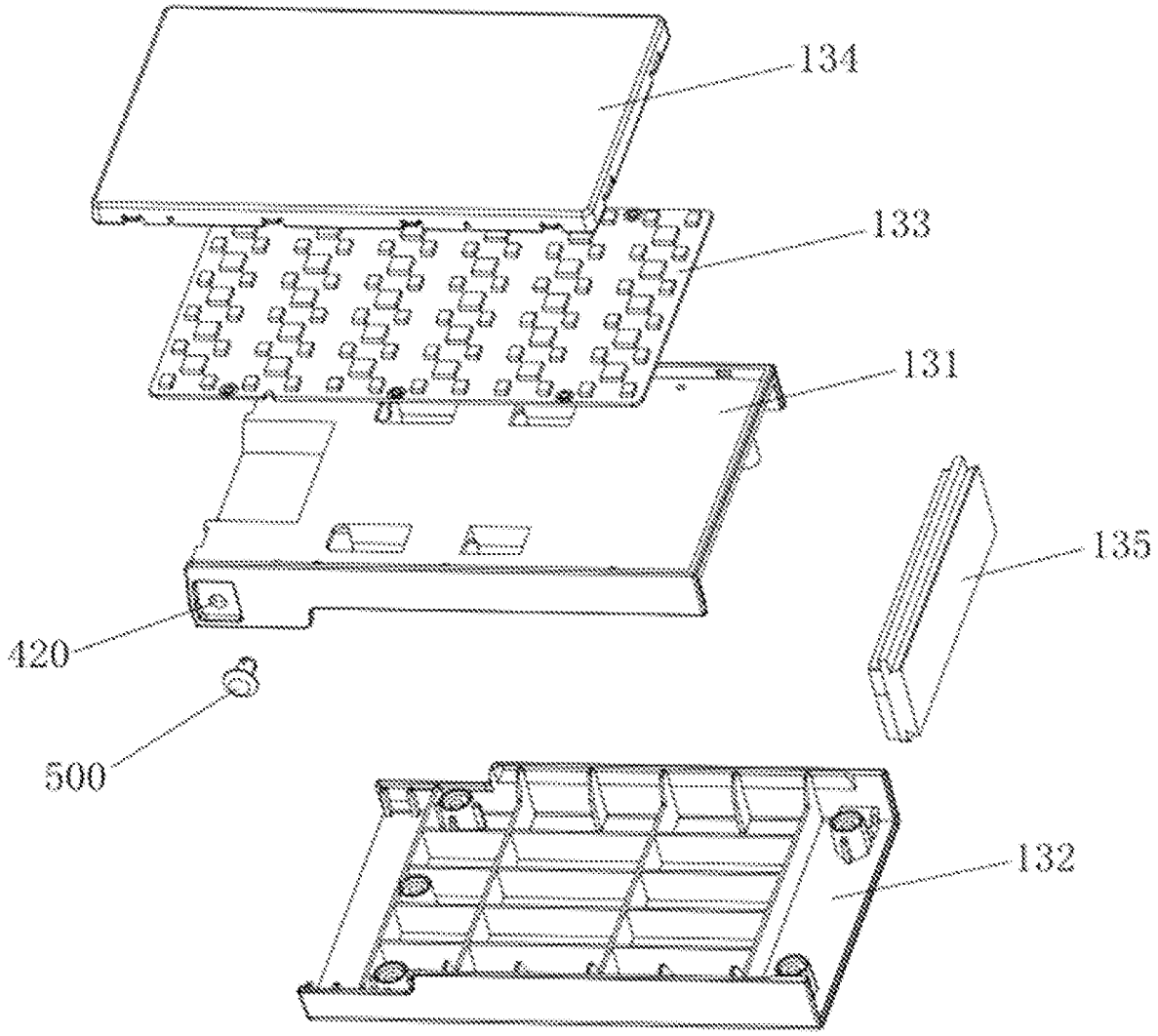
FIG. 8 is an exploded view of the tail end lamp body assembly according to one embodiment of the invention.

Referring now to FIG. 8, the tail-end segment 130 may include the tail-end bottom casing or shell 131, the tail-end surface casing or shell 132, the tail-end lamp board 133, and tail-end lampshade 134. In one aspect, the tail-end bottom casing or shell 131 and the tail-end surface casing or shell 132 may reciprocally match. In another embodiment, the tail-end lampshade 134 and the tail-end bottom casing or shell 131 may be snap to the side facing away from the tail-end surface casing or shell 132. In one aspect, the connecting member 200 may be disposed between the tail-end bottom casing or shell 131 and the tail-end surface casing or shell 132. In one aspect, the tail-end lamp board 133 may be configured on the one side of the tail-end bottom casing or shell 131 facing away from the tail-end surface casing or shell 132 and may be covered by the tail-end lampshade 134. In one aspect, the tail-end lamp board 133 may be secured on the tail-end bottom casing or shell 131. In a further aspect, the tail-end lampshade 134 may be snapped to the tail-end bottom casing or shell 131, and the tail-end bottom casing or shell 131 may be secured to the tail-end surface casing or shell 132. In a further aspect, the tail-end surface casing or shell 132 may be secured to one end of the tail-end bottom casing or shell 131 through a quick-release member B 135.

According to embodiments of the invention, the head-end lamp board 114, the intermediary lamp board 122, and the tail-end lamp board 133 may be connected in a series via electrical wire. In one aspect, the wire may include a certain flexibility to allow bending of the bendable fill light lamp 100. In a further aspect, the head-end electrical circuit board 113 may simultaneously control or configure the switch or on/off of the head-end lamp board 114, the intermediary lamp board 122, and the tail-end lamp board 133. In one aspect, the battery 116 may provide the power or energize the head-end electrical circuit board 113, the head-end lamp board 114, the intermediary lamp board 122, and the tail-end lamp board 133. As such, with this configuration, the head-end electrical circuit board 113 may control or configure multiple segments and multiple sets of the bendable fill light lamp 100 with the battery 116. This further may, in one embodiment, simplify the configuration and design of the structure and configuration of the intermediary segment 120 and the tail-end segment 130. With this flexibility, the cost of manufacturing of the bendable fill light lamp may be reduced. In yet another embodiment, the head-end lamp board 114, the intermediary lamp board 122, and the tail-end lamp board 133 may be in blocks or rectangular shaped. In one aspect, each of the boards may include a plurality of light beads, and the plurality of light beads may be evenly arranged in a matrix to improve the uniformity and continuity of the light emission.

Figure 9:
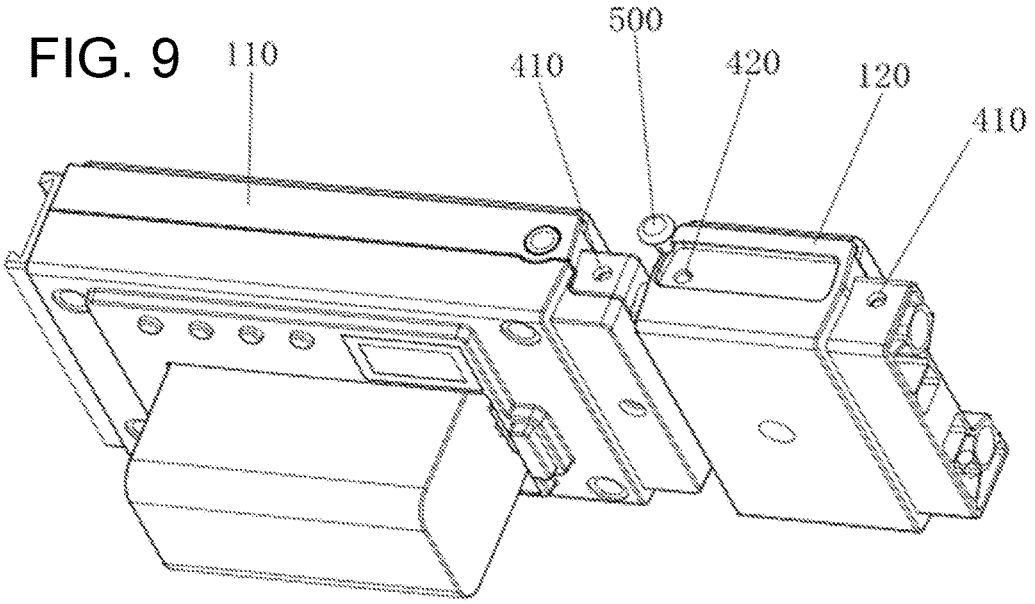
FIG. 9 is a schematic structural diagram of the head-end segment and the intermediary segment before the connecting pin according to one embodiment of the invention.
Figure 10:
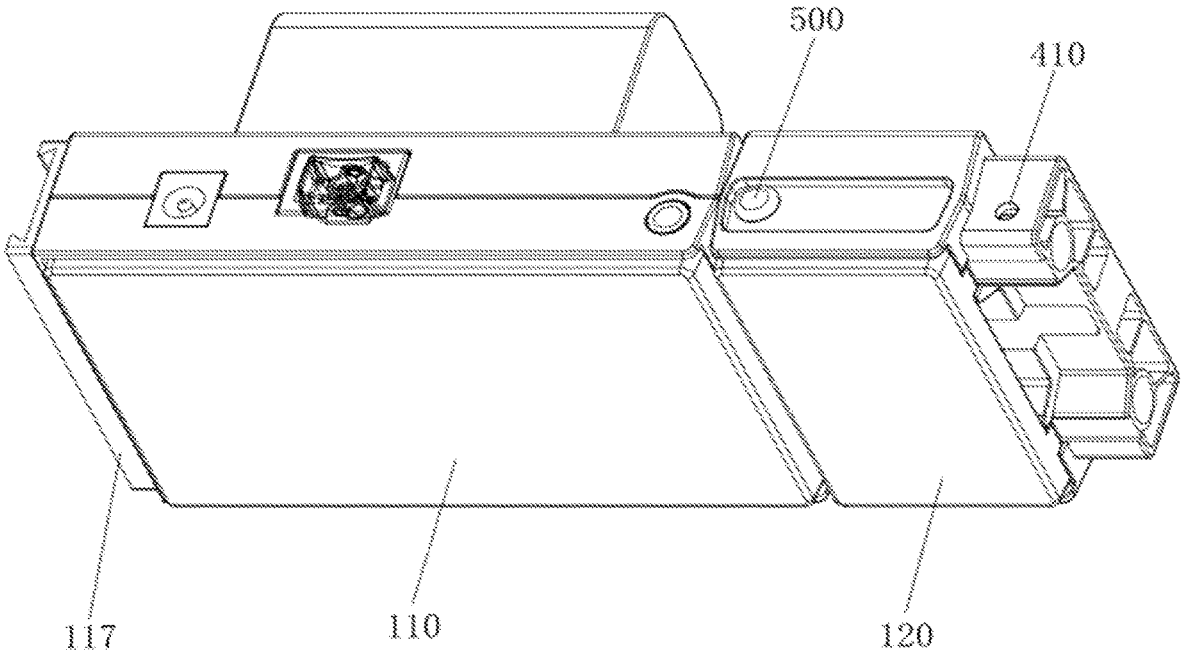
FIG. 10 is a schematic structural diagram of the head-end segment and the intermediary after a connecting pin is inserted according to one embodiment of the invention.
Figure 11:
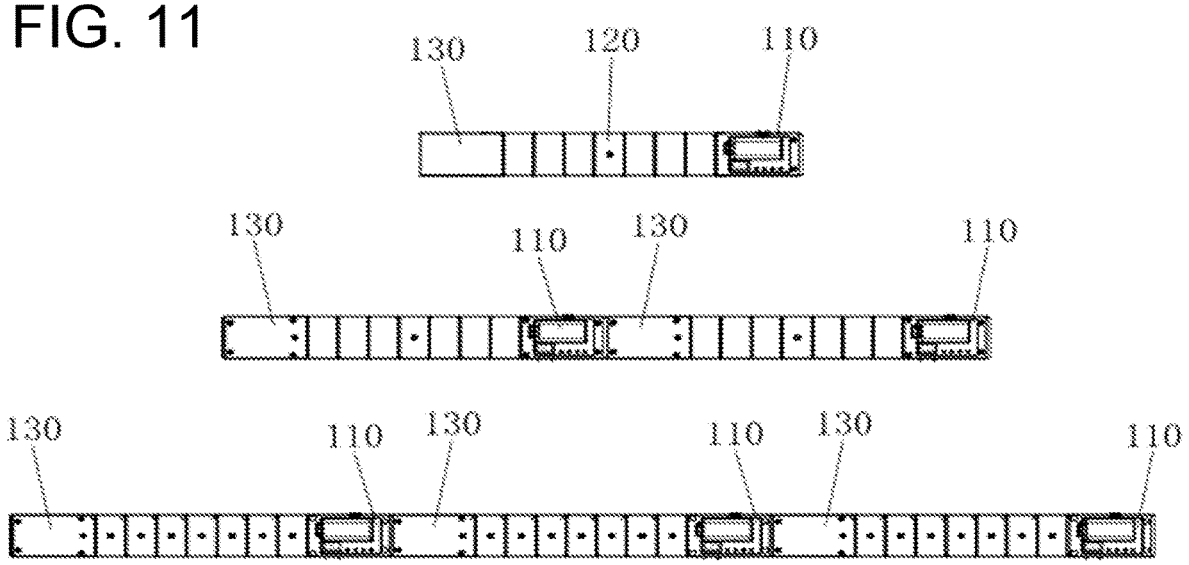
FIG. 11 is a schematic structural diagram of laterally connecting of one segment, two segments and three segments according to one embodiment of the invention.
Figure 12:
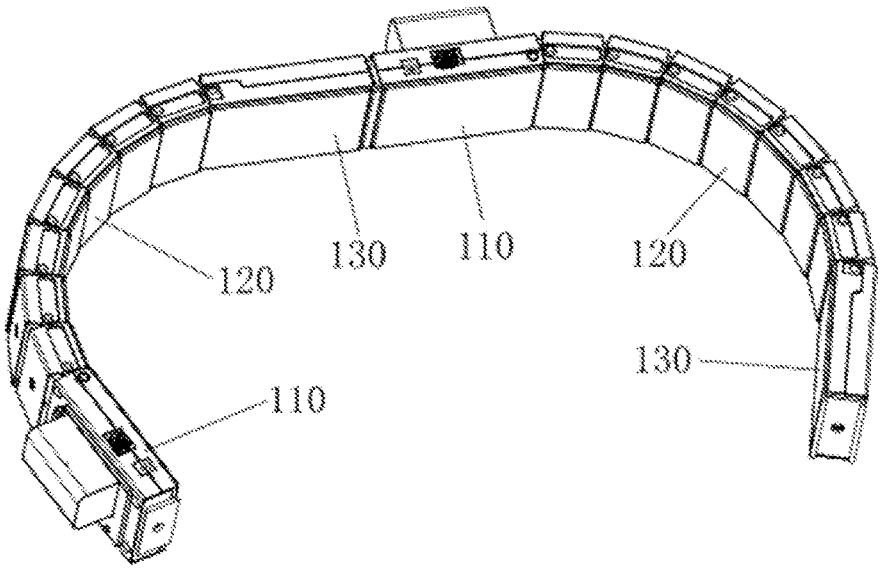
FIG. 12 is a schematic diagram of an overall structure of an embodiment of the present invention when two assemblies of fill light lamp assemblies are laterally connected and are in a forward curved arrangement.
Figure 13:
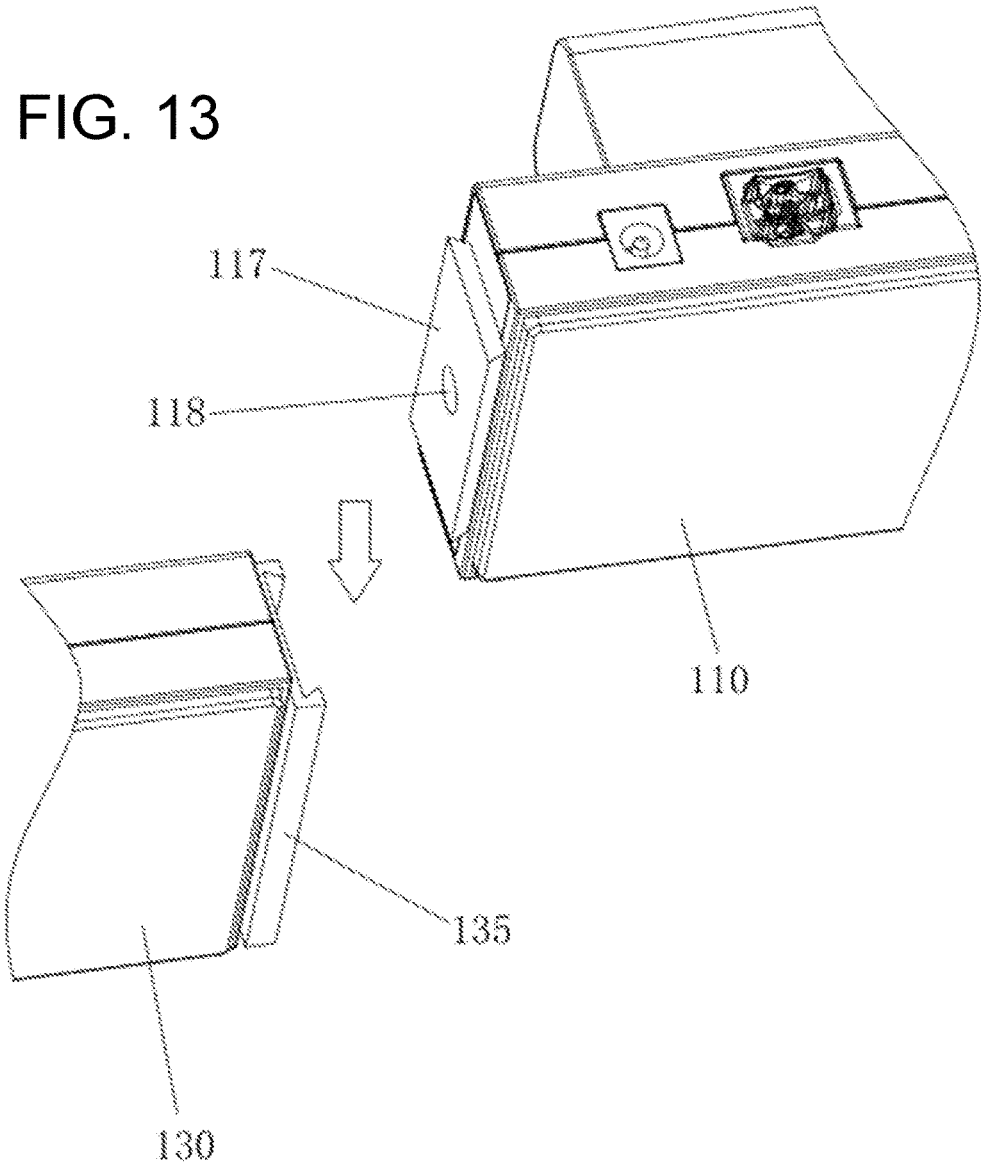
FIG. 13 is a schematic structural diagram of the head-end segment and the tail-end segment according to one embodiment of the invention before connecting.
Figure 14:
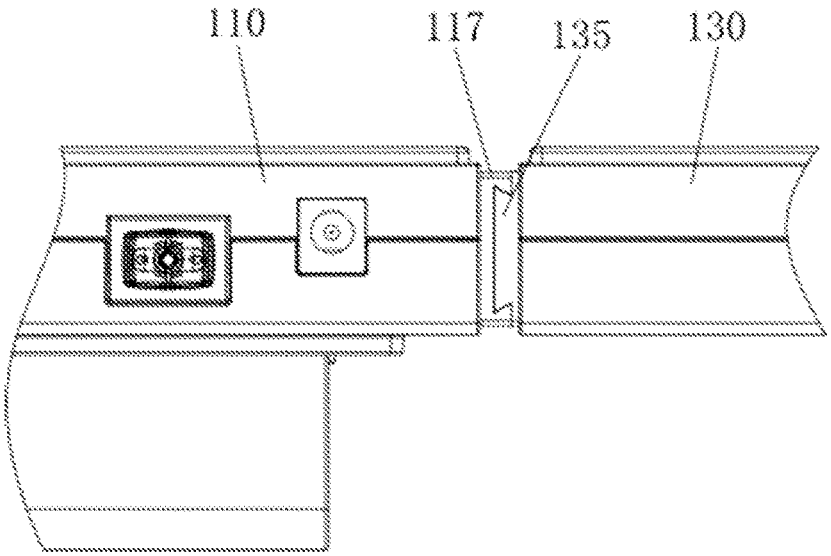
FIG. 14 is a schematic structural diagram of the head-end segment and the tail-end segment after being connected according to one embodiment of the invention.

Referring now to FIGS. 9-10, the head-end segment 110 may include a connecting port 400 extending or protruding on one side. In another embodiment, the end of the intermediary segment 120 that is close to the head-end segment 110 may include an installation groove (not show) to receive the connecting port 400. In one aspect, adjacent segments or the bendable fill light lamp 100 may be connected via the connecting port 400 through the installation groove. In this arrangement or configuration, it can ensure that the adjacent segments are stably or securely attached and reduce the gaps between the segments to maximize the area of fill light and the scope of the fill effect. In one aspect, the facing sides of the connecting port 400 may include the first installation hole 410. In one aspect, the intermediary segment 120 may include facing sides thereof to include the second installation hole 420 that matches with the first installation hole 410. In one embodiment, the connecting pin 500 may be disposed between the first installation hole 410 and the second installation hole 420. The head-end segment 110 and the intermediary segment 120 may rotate about the connecting pin 500. Accordingly, the same way of rotation may be applicable to the adjacent segments of the intermediary segment 120; the intermediary segment 120 and the tail-end segment 130; the head-end segment 110 and the intermediary segment 120. In an alternative embodiment, the rotational connection structure between two adjacent segments may also include a hinge connection structure.

As shown in FIGS. 11-14, the head-end segment 110 and the tail-end segment 130 on the other fill light may be detachably connected through the quick-release member A 117 and the quick-release member B 135. In one embodiment, the horizontal connection of two or more bendable fill light lamp may achieve a larger length and a larger angle fill light effect as needed. Specifically, one of the quick-release member A 117 and the quick-release member B 135 may be provided with a dovetail type chute, and the other is provided with a dovetail type slider. The quick-release member A 117 and the quick-release member B 135 may provide the quick connection of the head-end segment 110 and the tail-end segment 130 through the dovetail chute. In another aspect, it is to be understood that the sliding fit of the dovetail slider associated with the installation of the quick-release member A 117 and the quick-release member B 135 may be interchangeably positioned or configured. In an alternative embodiment, the head-end segment 110, the tail-end segment 130 are not limited to the above-mentioned quick-release member A 117, the quick-release member B 135, or the slot matching connection method. In one aspect, the head-end segment 110 and the tail-end segment 130 may also be attached with magnets or screw connections. It is to be understood that other connecting methods may be used without departing from the scope or spirit of embodiments of the invention.

Figure 15:
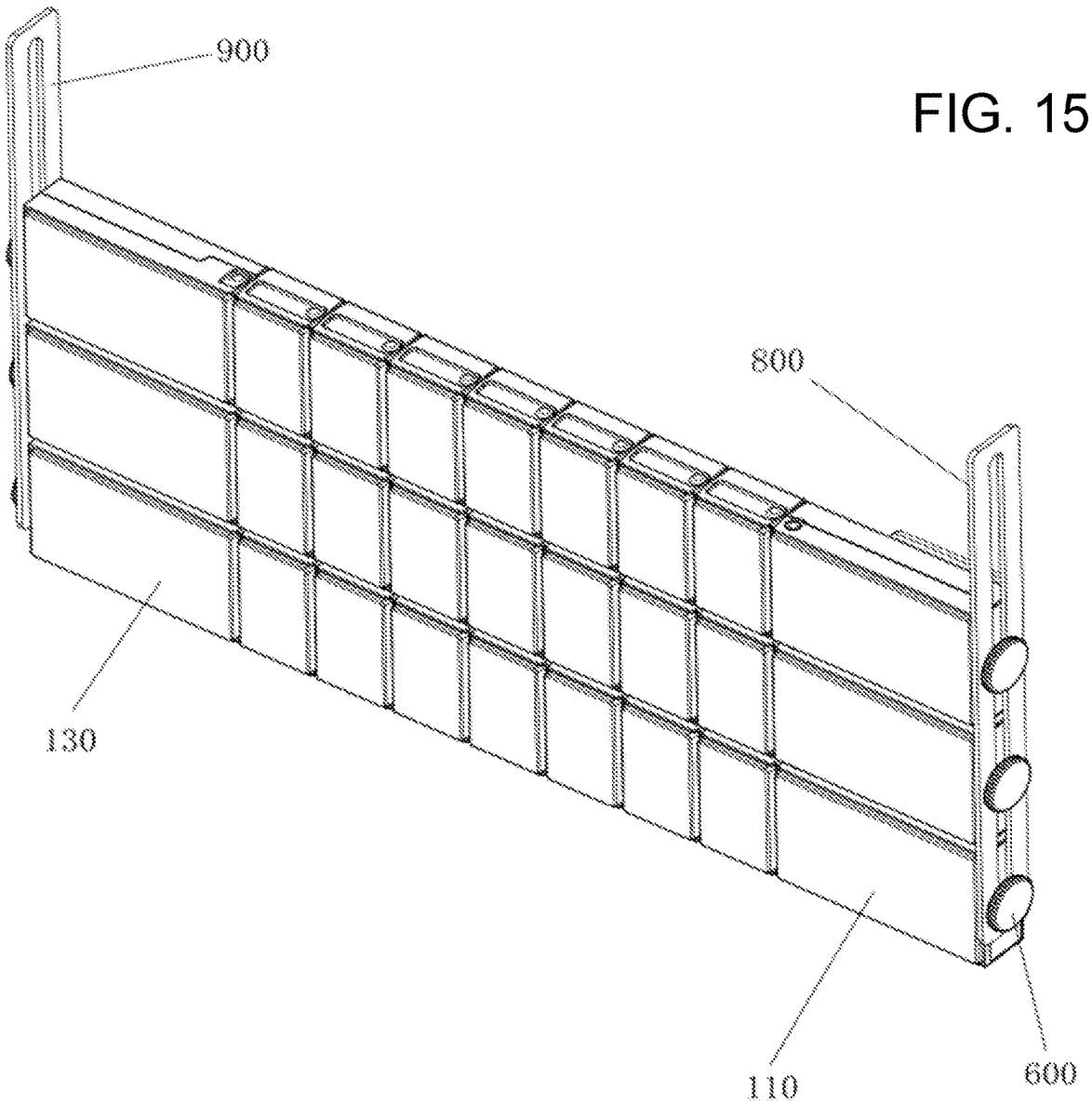
FIG. 15 is a schematic diagram of an overall structure of the embodiment of the present invention when three segments of the intermediary segments are longitudinally connected together in a state of parallel arrangement.
Figure 16:
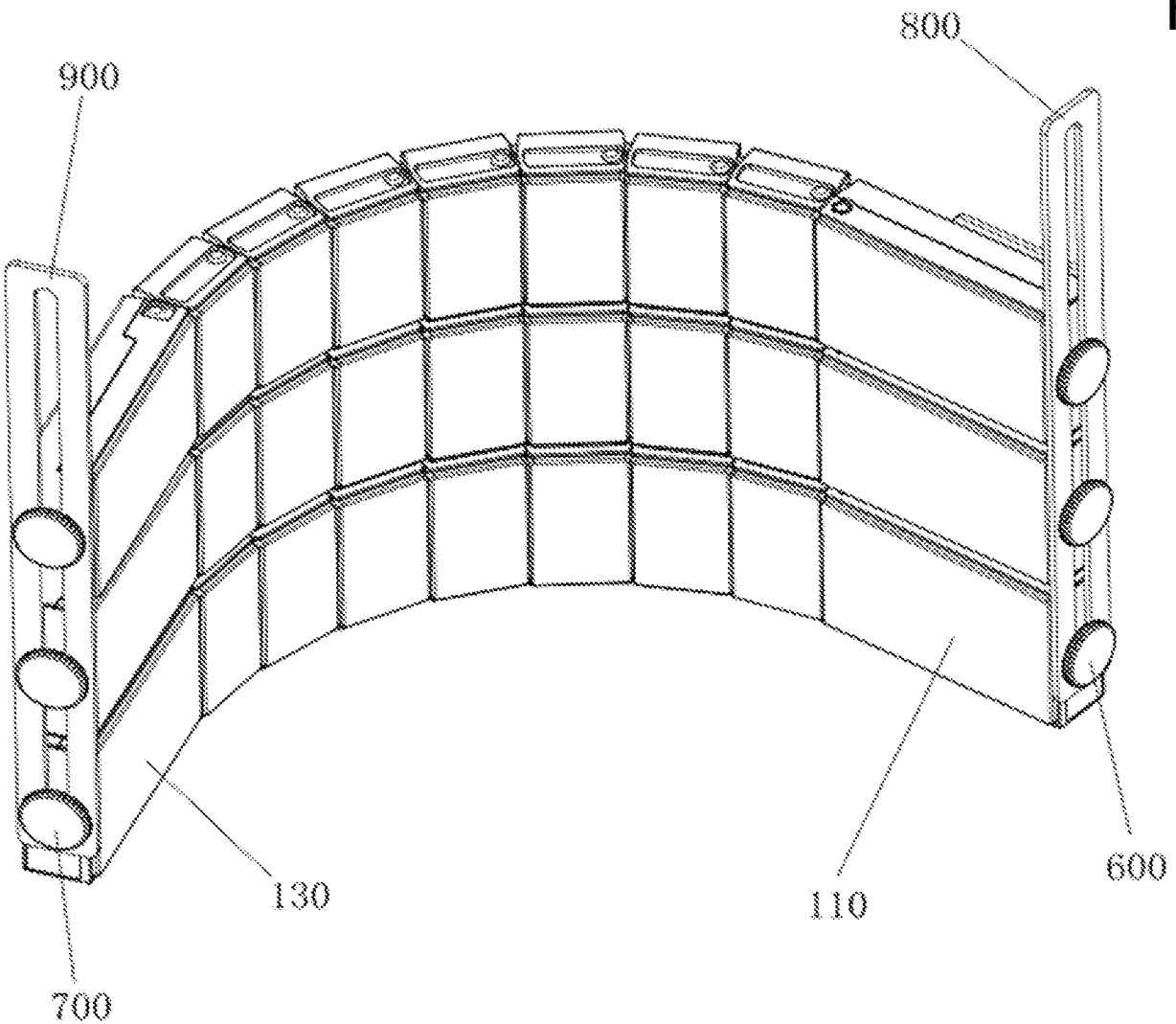
FIG. 16 is a schematic diagram of an overall structure of the embodiment of the invention when three sections of intermediary segments are longitudinally connected in a curved arrangement.
Figure 17:
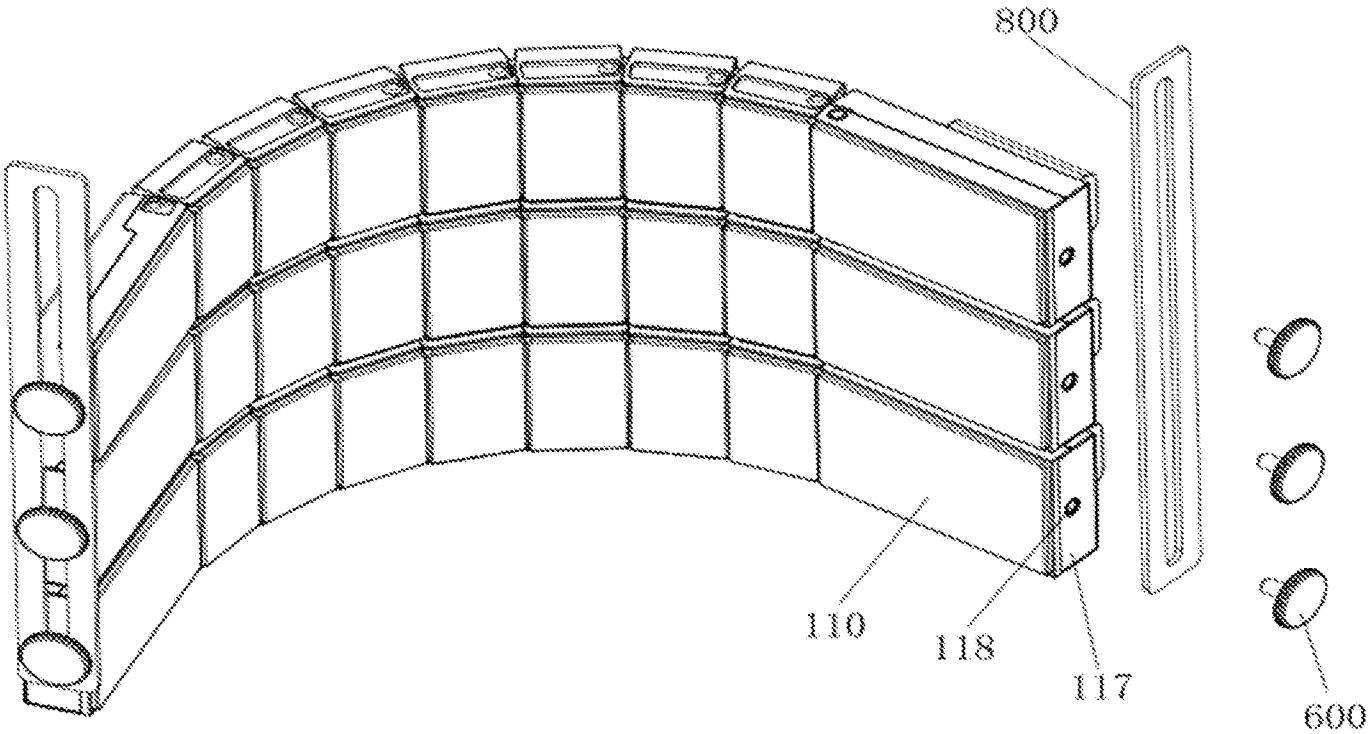
FIG. 17 is a schematic diagram of a connection relationship between the head-end segment, a head-end connecting pin, and a head-end connection bracket according to one embodiment of the invention.

As shown in FIGS. 15-17, in one embodiment, the longitudinal connection of the plurality of the intermediary segments 120 may be realized by connecting the two ends of the plurality of the intermediary segments 120 through the longitudinal connection structure. In one embodiment, the end of the head-end segment 110 facing away from the intermediate segment 120 may be provided with a head-end mounting hole 118 for mounting the head-end connecting pin 600, and the end of the tail-end segment 130 facing away from the intermediary segment 120 may be provided with a tail-end mounting hole to receive the tail-end connecting pin 700. In one aspect, the head-end mounting hole 118 may be disposed on the quick-release member A 117, and the tail-end mounting hole may be disposed on the quick-release member B 135. In one aspect, the longitudinal connecting structure may include the head-end connecting bracket 800 and the tail-end connecting bracket 900. In one aspect, the head-end connecting bracket 800 and the tail-end connecting bracket 900 may be of the same structure and may all be configured with a strip of holes or openings thereon. In one aspect, a plurality of longitudinally arranged head-end connecting pins 600 may be connected to the head-end mounting hole 118 through one hole on the same head-end connecting bracket 800. In another aspect, a plurality of longitudinally arranged tail-end connecting pins 700 may be connected to the tail-end mounting hole through one hole on the same tail-end connecting bracket 900. With such a structure, a plurality of intermediary segments may be longitudinally connected as a whole, and a larger area fill light effect may be achieved.

In summary, the bendable fill light lamp of embodiments of the invention may enable a fill light angle that may be adjusted at will as required. In one aspect, the continuity and uniformity of fill light may be accomplished and the phenomenon of multiple lamp spots and other disadvantages may be removed. Further, the multiple segments of the bendable fill light lamp may be combined horizontally and vertically as needed, thus achieving a larger angle and a wider range of continuous fill light.

The uniformity effect lamp for supplementary light is composed of multi-segment lamp body assemblies connected in sequence, any two adjacent lamp body assemblies can be rotatably connected, and a bendable connecting member 200 is passed between the multi-segment lamp body assemblies to supplement the light. During the use of the light lamp, the bending of the connecting member 200 may drive multiple lamp body segments to bend, so as to realize the sequential adjustment of the illumination angles of the light-emitting surfaces on the multiple lamp body assemblies; the fill light angle of the fill light can be adjusted at will as required, and the supplementary light is continuous, the uniformity of the supplementary light is better, and the phenomenon of multiple lamp eyes on the object to be photographed will not appear during photography, which improves the shooting effect. When the fill light is arranged in a straight line, the parallel fill light function can be realized; when the fill light is in a forward curved arrangement, the spot fill light function can be realized; when the fill light is in a backward curved arrangement When the astigmatism is used, the astigmatism and supplementary light function can be realized; the angle of the supplementary light can be adjusted according to the needs, and the supplementary light is continuous, and the uniformity of the supplementary light is better. In addition, the multi-section fill light can be spliced horizontally and vertically, which can achieve a larger angle and a larger area of fill light effect.

Obviously, the above-mentioned embodiments are only examples of the description, and are not intended to limit the implementation manner. For those of ordinary skilled in the art, changes or modifications in other different forms can also be made on the basis of the above description. There is no need and cannot be exhaustive of all implementations here. And the obvious changes or changes derived from this are still within the scope of protection created by the present application.

What is claimed is:

1. A bendable fill light lamp comprising:

a plurality of segments of a lamp body assembly connected in a series or a sequence, wherein the lamp body assembly comprises a body for connecting the plurality of segments;

wherein any two adjacent segments of the plurality of the segments are rotatably connected;

wherein each of the plurality of the segments comprises a light-emitting surface as a fill light source;

wherein the body comprises a connecting member passing among the plurality of the segments;

wherein the connecting member comprises a bendable elastic body;

a protruding connecting port disposed on a first end of a first segment of the any two adjacent segments, and an installation groove in a second end of a second segment of the any two adjacent segments to receive the connecting port;

wherein the connecting port comprises a first installation hole on one side wall;

wherein the second segment comprises a second installation hole on another side wall at a location matching that of the first installation hole; and a connecting pin passing through the first installation hole and the second installation hole so that the first segment and the second segment may be rotate about the connecting pin.

2. The bendable fill light lamp according to claim 1, wherein the light-emitting surface of each of the segments is disposed on one side of the lamp body assembly.

3. The bendable fill light lamp according to claim 1, wherein the connecting member 200 may be configured to be in a parallel arrangement state of straight line arrangement, a forward curved arrangement state of curved toward the light-emitting surface, and a back-curved arrangement state of curved away from the light-emitting surface.

4. The bendable fill light lamp according to claim 3, wherein the light-emitting surface of each of the segments is disposed on the same plane when in the parallel arrangement state.

5. The bendable fill light lamp according to claim 1, wherein each of the plurality of segments comprises a connecting channel for receiving the connecting member, wherein the connecting member passes through the connecting channel.

6. The bendable fill light lamp according to claim 1, wherein the connecting member comprises a bendable metal tube or metal plate.

7. The bendable fill light lamp according to claim 1, wherein the lamp body assembly comprises a head-end segment, a tail-end segment, and one or more intermediary segments disposed between the head-end segment and the tail-end segment.

8. The bendable fill light lamp according to claim 7, wherein the head-end segment comprises a head-end bottom casing, a head-end surface casing, a head-end electrical circuit board, a head-end lamp board, a head-end lampshade, and a battery; wherein the head-end bottom casing is connected to the head-end surface; wherein the head-end lampshade is connected to one side of the head-end surface casing away from the head-end bottom casing; wherein the head-end electrical circuit board is disposed in the head-end bottom casing and the head-end surface casing; wherein the connecting member is disposed between the head-end bottom casing and the head-end surface casing; wherein the head-end lamp board is disposed on one side of the head-end surface casing away from the head-end bottom casing and is covered by the head-end lampshade; wherein the battery is disposed on one side of the head-end bottom casing away from the head-end surface casing.

9. The bendable fill light lamp according to claim 7, wherein the intermediary segment comprises an intermediary main body, an intermediary lamp board, and an intermediary lampshade; wherein the connecting member is disposed in the intermediary main body, wherein the intermediary lampshade is connected to one side of the intermediary main body, wherein the intermediary lamp board is disposed on the intermediary main body and covered by the intermediary lampshade.

10. The bendable fill light lamp according to claim 7, wherein the tail-end segment comprises a tail-end bottom casing, a tail-end surface casing, a tail-end lamp board, a tail-end lampshade; wherein the tail-end bottom casing and the tail-end surface casing are complimentary connected; wherein the tail-end lampshade is connected to one side of the tail end surface casing away from the tail-end bottom casing; wherein the connecting member is disposed between the tail-end bottom casing and the tail-end surface casing; wherein the tail-end lamp board is disposed on a side of the tail-end bottom casing away from the tail-end surface casing and is covered by the tail-end lampshade.

11. The bendable fill light lamp according to claim 7, wherein one end of the head-end segment away from the intermediary segment and one end of the tail-end segment away from the intermediary segment comprise a connection via a quick-release device.

12. The bendable fill light lamp according to claim 11, further comprising a quick-release member A disposed on the one end of the head-end segment away from the intermediary segment; and further comprising a quick-release member B disposed on the one end of the tail-end segment away from the intermediary segment, wherein the quick-release member A matches with the quick-release member B; wherein the quick-release member A and the quick-release member B are complimentary and connect the lamp body assembly laterally.

13. The bendable fill light lamp according to claim 7, further comprising a head-end mounting hole for receiving a head-end connecting pin disposed on the one end of the head-end segment away from the intermediary segment;

further comprising a tail-end mounting hole for receiving a tail-end connecting pin disposed on the one end of the tail-end segment away from the intermediary segment;

further comprising a head-end connecting bracket for connecting one or more head-end connecting pins; and further comprising a tail-end connecting bracket for connecting one or more tail end connecting pins.

14. A bendable fill light lamp comprising:

a plurality of segments of a lamp body assembly connected in a series or a sequence, wherein the lamp body assembly comprises a body for connecting the plurality of segments;

wherein any two adjacent segments of the plurality of the segments are rotatably connected;

wherein each of the plurality of the segments comprises a light-emitting surface as a fill light source;

wherein the body comprises a connecting member passing among the plurality of the segments;

wherein the connecting member comprises a bendable elastic body;

wherein the lamp body assembly comprises a head-end segment, a tail-end segment, and one or more intermediary segments disposed between the head-end segment and the tail-end segment;

wherein the head-end segment comprises a head-end bottom casing, a head-end surface casing, a head-end electrical circuit board, a head-end lamp board, a head-end lampshade, and a battery;

wherein the head-end bottom casing is connected to the head-end surface; wherein the head-end lampshade is connected to one side of the head-end surface casing away from the head-end bottom casing;

wherein the head-end electrical circuit board is disposed in the head-end bottom casing and the head-end surface casing;

wherein the connecting member is disposed between the head-end bottom casing and the head-end surface casing;

wherein the head-end lamp board is disposed on one side of the head-end surface casing away from the head-end bottom casing and is covered by the head-end lampshade; and wherein the battery is disposed on one side of the head-end bottom casing away from the head-end surface casing.

15. The bendable fill light lamp according to claim 14, wherein the intermediary segment comprises an intermediary main body, an intermediary lamp board, and an intermediary lampshade; wherein the connecting member is disposed in the intermediary main body, wherein the intermediary lampshade is connected to one side of the intermediary main body, wherein the intermediary lamp board is disposed on the intermediary main body and covered by the intermediary lampshade.

16. The bendable fill light lamp according to claim 14, wherein the tail-end segment comprises a tail-end bottom casing, a tail-end surface casing, a tail-end lamp board, a tail-end lampshade; wherein the tail-end bottom casing and the tail-end surface casing are complimentary connected; wherein the tail-end lampshade is connected to one side of the tail end surface casing away from the tail-end bottom casing; wherein the connecting member is disposed between the tail-end bottom casing and the tail-end surface casing; wherein the tail-end lamp board is disposed on a side of the tail-end bottom casing away from the tail-end surface casing and is covered by the tail-end lampshade.

17. The bendable fill light lamp according to claim 14, wherein one end of the head-end segment away from the intermediary segment and one end of the tail-end segment away from the intermediary segment comprise a connection via a quick-release device.

18. The bendable fill light lamp according to claim 17, further comprising a quick-release member A disposed on the one end of the head-end segment away from the intermediary segment; and further comprising a quick-release member B disposed on the one end of the tail-end segment away from the intermediary segment, wherein the quick-release member A matches with the quick-release member B; wherein the quick-release member A and the quick-release member B are complimentary and connect the lamp body assembly laterally.

19. The bendable fill light lamp according to claim 14, further comprising a head-end mounting hole for receiving a head-end connecting pin disposed on the one end of the head-end segment away from the intermediary segment;

further comprising a tail-end mounting hole for receiving a tail-end connecting pin disposed on the one end of the tail-end segment away from the intermediary segment;

further comprising a head-end connecting bracket for connecting one or more head-end connecting pins; and further comprising a tail-end connecting bracket for connecting one or more tail end connecting pins.

* * * * *